US008668228B2

(12) United States Patent
Holmberg

(10) Patent No.: US 8,668,228 B2
(45) Date of Patent: Mar. 11, 2014

(54) LAY FLAT BOOK SHEETS

(75) Inventor: Thomas A. Holmberg, Andover, MN (US)

(73) Assignee: Holmberg Company, Inc., Minneapolis, MN (US)

( * ) Notice: Subject to any disclaimer, the term of this patent is extended or adjusted under 35 U.S.C. 154(b) by 1384 days.

(21) Appl. No.: 12/042,867

(22) Filed: Mar. 5, 2008

(65) Prior Publication Data

US 2008/0220211 A1 Sep. 11, 2008

Related U.S. Application Data

(60) Provisional application No. 60/893,049, filed on Mar. 5, 2007.

(51) Int. Cl.
*B42D 1/00* (2006.01)
*B42D 5/00* (2006.01)
*B42F 13/00* (2006.01)

(52) U.S. Cl.
USPC ..... 281/38; 281/40; 402/79

(58) Field of Classification Search
USPC ..... 283/38, 40; 402/79; 281/38, 40
See application file for complete search history.

(56) References Cited

U.S. PATENT DOCUMENTS

| | | | | | |
|---|---|---|---|---|---|
| 218,283 | A | * | 8/1879 | Lamb | 281/40 |
| 256,022 | A | * | 4/1882 | Megee | 281/24 |
| 649,061 | A | * | 5/1900 | Leechman | 281/38 |
| 1,913,320 | A | | 6/1933 | Woodward | |
| 1,962,407 | A | | 6/1934 | Pierce | |
| 4,147,380 | A | * | 4/1979 | Nelson | 281/29 |
| 4,294,029 | A | * | 10/1981 | Holson | 40/388 |
| 4,447,481 | A | * | 5/1984 | Holmberg et al. | 281/38 |
| 4,540,612 | A | * | 9/1985 | Rhyner | 281/2 |
| 5,063,637 | A | * | 11/1991 | Howard et al. | 281/29 |
| 5,096,229 | A | | 3/1992 | Carlson | |
| 5,207,456 | A | | 5/1993 | Danhoff | |
| 5,370,420 | A | | 12/1994 | Khatib et al. | |
| 5,401,058 | A | | 3/1995 | Holmberg | |
| 5,456,496 | A | | 10/1995 | Kadish | |
| 5,702,802 | A | | 12/1997 | Rettker et al. | |
| 5,941,569 | A | * | 8/1999 | Solomons | 281/40 |
| 6,061,943 | A | | 5/2000 | Pepys | |

(Continued)

FOREIGN PATENT DOCUMENTS

| | | | |
|---|---|---|---|
| EP | 1103387 | A1 | 5/2001 |
| JP | 56-140479 | U | 10/1981 |

(Continued)

OTHER PUBLICATIONS

Authorized officer Nora Lindner, International Preliminary Report on Patentability in PCT/US2008/055879 mailed Sep. 17, 2009, 6 pages.

(Continued)

*Primary Examiner* — Kyle Grabowski
(74) *Attorney, Agent, or Firm* — Fish & Richardson P.C.

(57) ABSTRACT

A sheet stock having a flexible hinge area is described. The sheet stock includes a substrate having an opening and gap stiffener, and a flexible film covering the opening and defining a flexible hinge area in the region of the opening and gap stiffener covered by the film. Methods for producing sheet stock having a flexible hinge area are also described. The sheet stock may be used in printing, binding, and in other applications.

18 Claims, 6 Drawing Sheets

(56) References Cited

U.S. PATENT DOCUMENTS

| | | | | |
|---|---|---|---|---|
| 6,746,050 | B2 | 6/2004 | Peleman | |
| 6,800,680 | B2 * | 10/2004 | Stark et al. | 428/352 |
| 6,846,531 | B2 * | 1/2005 | Mientus et al. | 281/38 |
| 7,309,082 | B1 | 12/2007 | Edwards | |
| 7,437,994 | B1 * | 10/2008 | Ratzloff | 281/40 |
| 2006/0061083 | A1 | 3/2006 | Didde | |

FOREIGN PATENT DOCUMENTS

| | | | |
|---|---|---|---|
| JP | 60-194580 | U | 12/1985 |
| JP | 04-368893 | | 12/1992 |
| JP | 6099689 | | 4/1994 |
| JP | 9136495 | A | 5/1997 |
| JP | 10-509925 | | 9/1998 |
| JP | 3053351 | U | 10/1998 |
| JP | 2000198290 | A | 7/2000 |
| JP | 2001088484 | | 4/2001 |
| WO | WO 96/16824 | | 6/1996 |

OTHER PUBLICATIONS

Stone Editions Online Store "Pre-hinged Printable Inkjet Album Pages" http://store.stoneeditions.com/prehinged.html, 3 pages downloaded Feb. 23, 2007.

"Notification of Transmittal of the International Search Report" dated Jun. 23, 2008.

Office Action received in Chinese Patent Application No. 200880014414.2, mailed Jul. 7, 2010, 6 pages.

Office Action received in Japanese Patent Application No. 2009-552853, mailed Oct. 2, 2012, 3 pages.

* cited by examiner 2-1

2-2

LAY FLAT BOOK SHEETS

RELATED APPLICATIONS

This application claims the benefit of U.S. Provisional Application Ser. No. 60/893,049, filed Mar. 5, 2007 which is incorporated herein in its entirety by reference.

TECHNICAL FIELD

This invention relates generally to pages or sheets, and more specifically to pages or sheets that will lay flat when bound.

BACKGROUND

People have used traditional film cameras to take pictures for many years. The exposed film was taken or sent for processing. A laboratory processed the film from these cameras and prints of varying sizes were returned to the photographer. These prints were then stored or displayed in various ways. One method was to store and use many photos to create a photo album or photo book. These books held the photo in pockets, sleeves or with special corners or tape.

More recently, digital cameras have become very popular. Because of this, and the ease of access to the Internet, there has been a tremendous change in how many pictures are printed, displayed and stored. One of these changes is that people can now take pictures and then send them, via the Internet, to companies that can print their photos and return them by mail. Another option offered by these same companies is the ability to create a custom photo book or album from the pictures submitted. These photo books are created using software that can be downloaded by the photographer that allows them to control the content and appearance of the book.

Once the book has been created in digital form it is printed on specialized digital printing equipment that can efficiently print as little as one copy of a book. After printing, the pages are trimmed to size and bound creating a finished book. Typically these books are bound using a process sometimes called perfect binding. This approach would be used in creating a soft cover book. In this process the printed sheets are aligned together on the spine. An adhesive, usually a hot melt adhesive, is applied to the edge of the spine and a cover is quickly wrapped around the stack of sheets and held firmly. After the adhesive cools, the sheets have been bound into the cover and the book is finished.

In an alternative method to make a hard cover book, a hot melt adhesive is pre-applied by the manufacturer of the covers to the inside center of the cover. The end user can later take printed sheets and insert them into the cover. After insertion of the sheets into the cover, the cover is then placed on a heated plate spine end down. The hot melt adhesive softens to the point that the sheets sink into the adhesive. The heat is then removed and the adhesive cools, bonding the sheets into the cover. The book is then finished. There are many other methods for hard and soft cover book binding and these are only examples.

SUMMARY

In traditional binding, the bound sheets do not naturally lay flat and efforts to force the sheets to lay flat will either damage pages or binding. The described pages overcome these limitations by incorporating a flexible film area into the page, so that the pages lay flat when bound.

In one aspect, a sheet stock is described that includes a substrate including an opening and including a gap stiffener in the region of the opening, and a flexible film covering the opening and defining a flexible hinge area in the region of the opening and gap stiffener covered by the film.

A flexible film may be applied to the upper surface of the substrate and a flexible film may be applied to the lower surface of the substrate. The one or more flexible films may be compressed into the surface of the substrate. The flexible hinge area may be from about 0.03 inches to about 0.25 inches in width.

The sheet stock may include a flexible film applied to the upper surface of the substrate and a flexible film applied to the lower surface of the substrate. The flexible film may be compressed into the surface of the substrate. The flexible film may cover all or nearly all the surface of the substrate. Variously, the flexible film may be print receptive, xerographic toner receptive, ink jet printing receptive, or ElectroInk receptive. The flexible film may have a matte finish, a glossy finish, or other finish. The flexible film may be opaque, translucent, transparent, or semi-transparent.

Variously, the substrate may include paper, or may include film or plastic. The thickness of the substrate may be reduced in the area where the flexible film is applied to the substrate. There may be two or more separate openings in the substrate. The thickness of the sheet stock where the flexible film is applied may have a thickness that differs by 0.002" or less compared to the thickness of the sheet stock where the substrate is not covered by flexible film, or may have a thickness that differs by 0.001" or less compared to the thickness of the sheet stock where the substrate is not covered by flexible film. There may be a strip of substrate between the edge of the sheet stock and the edge of the flexible film.

In another aspect, a process for preparing a sheet stock is described that includes reducing the thickness of a portion of a substrate, removing a portion of the substrate in the area of reduced thickness, and applying flexible film onto one surface of the substrate in the area of reduced thickness, such that it covers the removed portion of the substrate to form a flexible hinge area. The process may also include applying flexible film onto the opposite surface of the substrate in the area of reduced thickness, such that it covers the reduced portion of the substrate. Thus, the flexible film may be applied to both the upper and lower surfaces of the substrate. The process may also include trimming the sheet stock to form a tabbed sheet stock. Removing a portion of the substrate in the area of reduced thickness may include removing portions of the substrate to create gap stiffeners in the flexible hinge area.

The portion of substrate may be removed by die cutting, by laser cutting, or other method. Reducing the thickness of a portion of a substrate may include sanding or grinding, calendaring, or other method. Variously, the substrate may include paper, or may include film or plastic.

In another aspect, a process for preparing a sheet stock is described that includes removing a portion of the substrate material to create one or more openings and one or more gap stiffeners, and applying a flexible film onto one surface of the substrate, such that it covers the one or more openings and one or more gap stiffeners of the substrate to form a flexible hinge area. The process may also include applying a flexible film onto the opposite surface of the substrate, such that it covers the one or more openings and one or more gap stiffeners of the substrate to form a flexible hinge area. The flexible film may cover all or nearly all the surface of the substrate. The flexible film may include a print receptive coating.

The process may also include trimming the sheet stock to form a tabbed sheet stock. The portion of substrate may be removed by die cutting, by laser cutting, or other method. The process may include reducing the thickness of the substrate. Reducing the thickness of a portion of a substrate may include sanding or grinding, calendaring, or other method. Variously, the substrate may include paper, or may include film or plastic.

In another aspect, a process for preparing a sheet stock is described that includes removing a portion of the substrate and applying flexible film onto the upper or lower surface of the substrate such that it covers the removed portion of the substrate and forms a flexible hinge area. The process may include applying film onto both the upper and lower surfaces of the paper, such that they both cover the removed portion of the substrate to form a flexible hinge area. Removing a portion of the substrate may include removing at least two separate portions. The portion of substrate may be removed by die cutting, or by laser cutting. The process may include reducing the thickness of a portion of the substrate. Reducing the thickness of a portion of a substrate may include sanding or grinding, or calendaring.

In another aspect, a binding arrangement is described that includes a front and back cover, and one or more pages including a substrate comprising an opening and including a gap stiffener in the region of the opening, and a flexible film covering the opening and defining a flexible hinge area in the region of the opening and gap stiffener covered by the film, and a binding element binding the page within the front and back cover, wherein the flexible hinge area enables the page to lie flat when the binding arrangement is opened. The one or more pages may include a print receptive coating. The binding arrangement may be in the form of a book.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
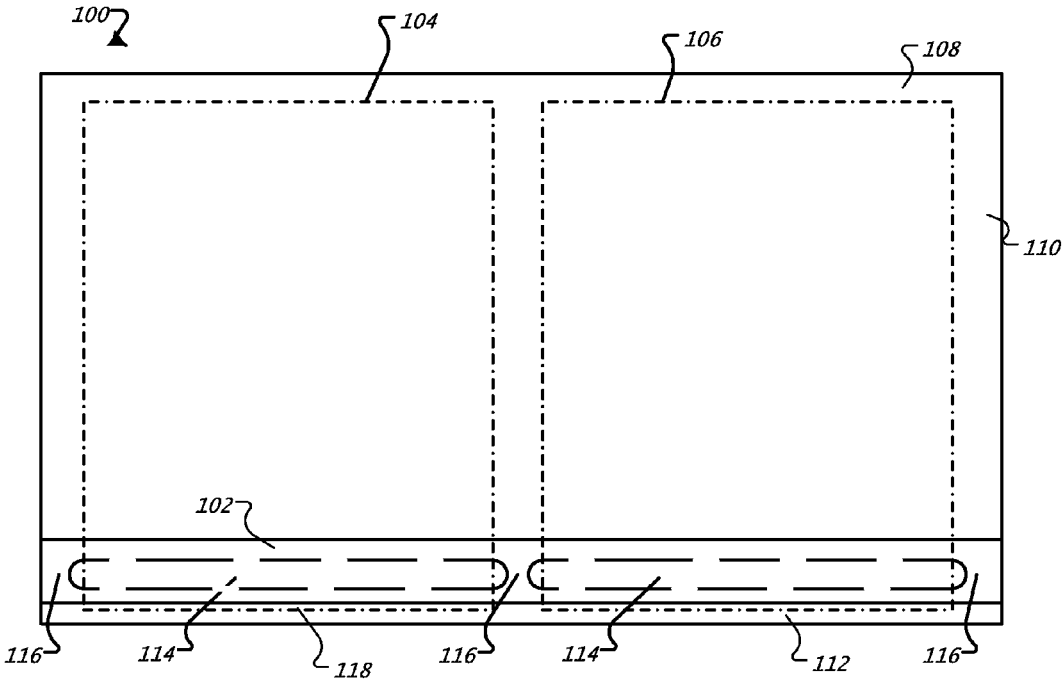
FIG. 1 shows a master sheet with a film strip attached.

While traditional perfect binding is quick and effective it has one significant drawback, which is also shared with many other binding methods. One significant drawback is that the bound sheets do not naturally lay flat, and efforts to force the sheets to lay flat will either damage the printed pages by creasing them, or will damage the binding by over bending, cracking, or separating the adhesive. When used for photo books, which are meant for display and viewing, these negative aspects are especially troublesome issues for books produced using the perfect binding method or other binding methods. Other binding methods used that also have the problem of generally not allowing the bound pages to lay flat include stapling, Velo binding, post binding, side sewing, etc.

The pages and methods described herein overcome these limitations by incorporating a flexible film area into a page sheet to create a flexible hinge area. The resulting pages may be used with many different binding methods, including perfect binding, Velo binding, post binding, stapling, side sewing, etc. When bound, the pages can lay flat due to the presence of the flexible film area. Examples of products that may incorporate these pages include photograph books, journals, drawing books, etc.

The pages generally include a substrate material and a flexible film area. Various substrate materials may be used including paper, film, plastic, cotton and other natural fibers, other materials, and combinations of materials. The substrate may be clear, cloudy, opaque, white, shaded, or colored. The substrate may be plain or patterned. Typically, paper will be used as the substrate material due to cost, flexibility, familiarity, or other reasons. In another approach, a film substrate may be used to produce waterproof sheets, as a film substrate will not wick water unlike a paper substrate. In other approaches, other materials or combinations of materials may be used as the substrate. In general, substrates of various weights, thicknesses, sizes, and materials may be used in the methods described and to produce the pages described.

The flexible film area includes a flexible film over a portion of the substrate where some or all of the substrate has been removed. Generally, the flexible film area may be of various dimensions, and may be located in various positions on the page, but typically will be located and sized to create a flexible hinge area. The flexible hinge area enables the pages to lie flat or nearly flat when bound together. In one approach, a strip of film is used to create the flexible film area. The flexible hinge area is generally defined by the one or more openings in the substrate, the one or more gap stiffeners and the flexible film covering the opening and one or more gap stiffeners. The width of the flexible hinge area is therefore measured as the width of the opening covered by the film. The flexible hinge area may have different widths, and may vary depend upon the size of the pages, the substrate material, the purpose for which the pages are made, or other factors. Overall, the flexible hinge area will be large enough to allow the pages to lie flat when opened. In general, the flexible hinge area will be from about 0.01 inches to about 1.0 inches in width, or from about 0.02 inches to about 0.5 inches in width, and preferably from about 0.03 inches to about 0.25 inches in width.

The strip of film runs generally parallel to the edge of the page, and there may be film strips located on the upper surface of the page, on the lower surface, or on both surfaces. In another approach, the film covers all or nearly all of the substrate page surface, and may be on one side or both sides of the page. In another approach, the film covers a majority of the page surface, on one or both sides of the page.

In general, films of different types, thicknesses, and surface treatments may be used. Various types of plastic flexible film may be used. Examples of suitable plastic films include polyethylene terephthalate films, polypropylene films, or films of other materials or blends of materials. Films of various thicknesses may also be used. Typically, the film used may have a thickness from 0.0001" to 0.01", and preferably 0.0005" to 0.005", though other thicknesses may also be used. The flexible film may also be untreated or treated to have various properties. For example, the film may have various surface properties, including coatings or surface treatments. Variously, the film surface may have an unfinished surface, matte finish, or glossy finish. A matte coating may be used for certain applications as the matte finish causes the film to blend into the color of the substrate and becomes virtually invisible. It may therefore have beneficial visual effect as it does not distract the users of the document. A glossy finish may be used for other applications. Examples of coatings and surface treatments include coatings or treatments that produce a film surface that is, for example, toner receptive, xerographic toner receptive, ink jet receptive, or HP ElectroInk receptive. One example of a coating or surface treatment is a film having a toner receptive coating (such as an WXO 51B coating from Environmental Inks and Coatings, Morganton, N.C.). The film may also have various visual properties, such as having a transparent, translucent, colored, or opaque character. Such visual properties may be present in the film, or imparted by a surface treatment on the film.

The pages may be formed from sheet stock. A sheet stock may be produced that may be used to form pages that may be used in photo books and other printed pieces. The sheet stock may be produced such that the sheet stock pages lie flat when bound or stacked together. The sheet stock may be produced in the form of master sheets (which may be printed and then from which the final pages are later cut or trimmed), or the sheet stock may be produced in the form of ready-to-print finished sheets. The master sheets may be in the form of a roll or individual pages (from which one or more finished pages are produced).

Production of the sheet stock generally includes unrolling a roll of substrate material and forming a web of material. The web is processed to remove some of the substrate material, film is applied, and then the master sheets are cut to final size. The processing will remove portions of the substrate from the sheet leaving open areas in the substrate. In addition, some of the thickness of the substrate may be removed or reduced in certain areas. Film may be applied to one or both sides of the substrate. The master sheets are finished by either creating a master sheet roll, or by cutting individual master sheet pages. The process steps are described in more detail below with respect to FIG. 1.

Uniform or near-uniform thickness of the page surface may be important in several applications. For example, if a stack of sheets is to be fed to a printer, the near-uniformity in thickness enables the sheets to be nearly parallel and assist in uptake by the printing equipments. Non-parallel sheets may cause jamming and delays in uptake and feeding during printing. For example, if one side of a stack of sheets is more than slightly higher than the other side (e.g., ¼" or higher, ½" or higher, ¾" or higher, 1" or higher, etc.), the sheets generally will not feed properly, resulting in a misfeed. The misfeed may result from mishandling, crooked feeding, binding up when feeding, or other problem caused by the height differential between the sides of the stack of sheets. In addition, uniformity in height may be beneficial in certain trimming operations. For example, a guillotine cutter may be used to trim the finished pages, and non-uniformity in thickness may lead to variation in the finished page sizes, whereas a stack having uniform thickness enables trimming of multiple pages to the same dimensions at the same time. In addition, uniformity in thickness may also be beneficial in binding operations.

In other applications, uniformity is not as important, and the thickness of the substrate need not be reduced. For example, pages may be produced for scrapbooking applications where the end user may wish to print on the page, and then also apply other items to the page, such as paper, decorations, etc. In this case, having the thickness of the film plus substrate greater than the thickness of the substrate only area would not be detrimental, and may even be beneficial.

FIG. 1 shows a master sheet 100 with a film strip 102 attached. Finished sheets, such as sheets 104 and 106, can be cut from the master sheet 100. The finished sheets 104, 106 may be formed by trimming or removing substrate edges 108, 110 and 112, around finished sheets 104, 106 off of the master sheet 100. The master sheet 100 can be printed before trimming to produce the finished sheets 104 and 106.

In various embodiments, the film strip 102 may be applied to the upper side, lower side, or both sides of the master sheet 100. The film strip 102 can be formed from a variety of film materials, and may include various coatings or surface treatments.

The substrate may be processed in various ways to produce lay flat sheets. Referring again to FIG. 1, portions of substrate 114 may be removed from the master sheet 100 before the application of the film strip 102. The substrate material can be removed by different methods, such as by die-cutting, laser cutting, or punching. Islands of substrate or gap stiffeners 116 can be left unremoved surrounding the cutouts 114. Leaving gap stiffeners 116 in the flexible hinge area adds a degree of additional stiffness to the master sheet in the area around the cutouts 114 compared to using film only. For example, if the cutouts 114 extend from edge to edge with no gaps in between, then the continuous flexible hinge edge may be too flexible and can be prone to jam in the printer during printing operations. The additional stiffness provided by the gap stiffeners 116 can help prevent such jams. The additional stiffness provided by the islands may also help maintain the pages in place and in proper orientation during trimming, cutting, and binding operations.

The thickness of the substrate underneath the film strip 102 may be reduced before the film strip 102 is applied. The thickness of the substrate may be reduced using various processes, including calendaring, sanding, or other methods. For example, the substrate may be sanded to reduce thickness using a high-speed sanding belt. The substrate may be thinned so that the thickness of the film 102 together with the substrate underneath the film strip 102 is similar to the thickness of the rest of the substrate. For example, the thicknesses between the substrate only area and the substrate plus film may vary by 0.002 inches or less, 0.001 inches or less, or may be the same thickness.

The film strip 102 may be applied to the substrate using an adhesive. Examples of adhesives that may be used include contact adhesives, fast-drying adhesives, and other adhesives. The adhesive may also include other additives, such as color, crosslinking additives, curing agents, etc. For example, a crosslinking additive may be added to the adhesive to improve performance, as the crosslinking additive will reduce the effects of heat on the adhesive bond during later printing operations of the pages.

In one approach, an adhesive layer is applied to the film strip 102 before application of the film strip 102 to the substrate. In another approach, the adhesive may first be applied to the substrate, and then the film strip applied. The film strip 102 may also be compressed into the substrate during or after application of the film strip to the substrate. The film strip 102 may be applied to cover the cutouts 114 formed from substrate removal. After the film strip 102 has been applied over the cutouts 114, the master sheet 100 has a flexible hinge along one edge.

Master sheets may be used by various types of commercial printing equipment, including laser printing, offset printing, flexographic printing, xerography, ink jet printing, etc. Master sheet stock may also be produced that may be run in personal printing equipment, such as laser printers and ink jet printers. In general, a master sheet may be produced in various forms and sizes, and may be produced with features that enable it to be run in specialized commercial printing equipment. The various designs allow for efficient and trouble free operation of the printing equipment and enable the production of a document with lay flat pages.

The sheet stock may be in the form of master sheets or finished sheets when printed. Pages may be produced from the sheet stock before or after printing, such as by cutting, or detaching the finished page from the master sheet. Producing the finished sheet after printing enables printing to cover the entire page. In other implementations, the pages may be produced to the final sizing before printing, and no post-printing steps would be required for the page prior to binding. In this approach, the master sheet may be cut to produce finished sheets before printing, and such an approach may be used for producing finished sheets to be used on certain types of equipment, or for use by consumers on home equipment.

Returning to FIG. 1, the master sheet 100 may be printed such that the printing "bleeds" off the edge of the area of finished sheets 104, 106. In this approach, the printing will extend to the edge of the finished sheets 104, 106, when they are trimmed from the master sheet 100. In various embodiments, printing may be done on top of the film strip 102, such that it blends with the rest of the printing. Different film finishes and appearances may be used, for various purposes. For example, using a film having a matte finish and toner receptive treatment may be especially suitable when printing over film covering the substrate or in the area of the flexible hinge.

Depending on the type of printing equipment used, the leading edge of the sheet stock may be the long edge or the short edge of the master sheet. In printing operations, if the leading edge of the sheet is too flexible, the printing operation may experience problems, such as jamming. If one of the leading edges is also the binding edge of sheet, and if the sheet is to be duplex printed (printed on both sides of the sheet), the problems may be particularly severe. These problems may become greater if the sheet stock uses a continuous flexible gap to act as a hinge, as the flexibility of the leading edge and the sheet may be increased. The gap stiffeners that remain in the sheet under the film layer may assist in solving these problems, as the islands act as stiffening members in the flexible hinge area. There may be one or more gap stiffeners in the flexible hinge area. Variously, one or more gap stiffeners present in the master sheet may be removed from the flexible hinge area by trimming the master sheet to produce the finished sheets. Therefore, zero, one, two or more gap stiffeners may be present in the finished sheet.

Many types of commercial printing equipment used to print this type of page (whether inkjet, laser, Electro ink or other) use a series of sensors to monitor the sheet as it passes through the press. These sensors use visible or invisible light to determine the sheet size and location of the sheet as it moves through the machine. This information is compared to settings that the operator has input to the machine. If the settings do not match the machine is signaled that something may be wrong and the machine may stop. Examples of what could be wrong include the machine feeding two sheets at a time, not feeding a sheet, the sheet being the wrong size etc. When a sheet, such as a sheet stock which has a slot cut into it, passes through this type of equipment the sensors may read this slot and interpret it as an error causing the machine to stop. Without correcting this condition the machine will not run.

Gap stiffeners 116 may also be otherwise useful in certain printing operations for printing equipment using optical sensors to assist in detecting and preventing jams. If a continuous, transparent layer runs lengthwise along the sheet stock, the optical sensors may not see the material, and sense a jam, stopping the printing process. The gap stiffeners 116 may assist in these cases, as the optical sensors will sense the material and allow continuous printing.

Alternatively, an opaque film may be used, which will block the sensor light in the same manner as the substrate. With this opaque film covering the slot the machine will act normally. In another variation, rather than using an opaque film, a clear film is coated with an opaque ink only in the area of the slot. This allows the film to appear clear when applied to the substrate portion but opaque in the cutout area. Using an opaque film or coating may also be visually desirable as it may improve the appearance of the printed page.

The master sheet 100 may include a small strip 118 that remains between the film strip 102 and the edge of the finished sheet 104. Static is used by some types of printing equipment to hold toner in place until it is fused to the page. When used in these types of printing operations, the strip 118 may assist in reducing static build up that can otherwise cause the film strip 102 to stick to printer fusing rollers. This may be particularly useful in some printers, where a large amount of static can build up when sheet stock laminated with plastic film, such as sheet 100, is run through certain printers. If the film strip 102 is on a lead edge of the sheet 100, static buildup can often cause the film strip to stick to the fuser rollers. By moving the plastic edge away from the sheet edge at least 1/16" the static change may be decreased or broken. Thus, when a strip 118 is left between the film strip 102 and the leading edge of the finished sheet 104, the static charge may be lessened or broken and the sheet edges may be less prone to jam, and the film layer may be less prone to stick to the fuser rollers. The strip 118 may be of various widths. For example, the strip 118 may have a width of about 1/32" or greater, about 1/16" or greater, about 1/8" or greater, about 1/4" or greater, or about 1/2" or greater.

FIG. 2 shows examples of finished sheets. The first embodiment, shown in FIG. 2A, is finished sheet 104. The finished sheet 104 can be cut from the master sheet 100 of FIG. 1. In alternative embodiments, a finished sheet may be manufactured and produced directly rather than trimmed from a master sheet 100. The finished sheet 104 is shown with the film strip 102 near the bottom edge. In the area of the hinge, portions of the substrate have been removed, resulting in the cutout 114 area that has been removed underneath the film strip 102. The film strip 102 has been placed so that a thin strip 118 remains between the film strip 102 and the edge of the finished sheet 104.

Figure 2A:
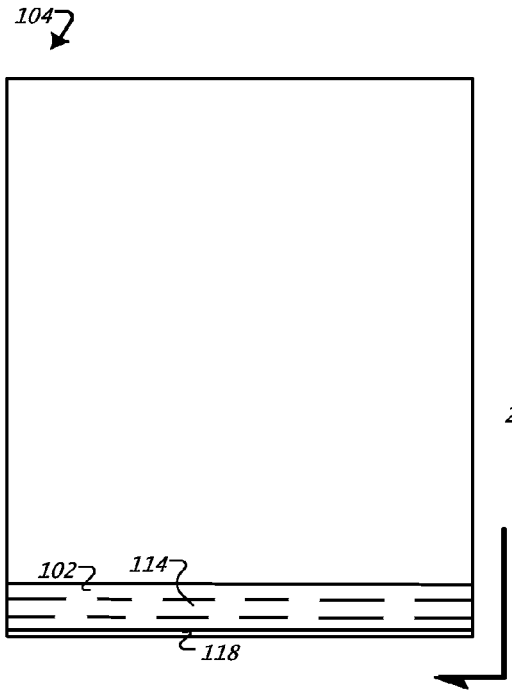
FIGS. 2A-2D show examples of finished sheets.
Figure 2C:
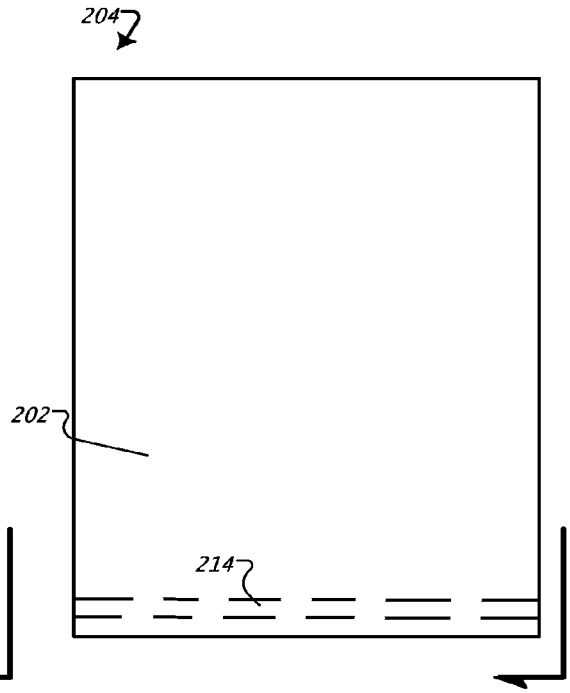
Figure 2B:
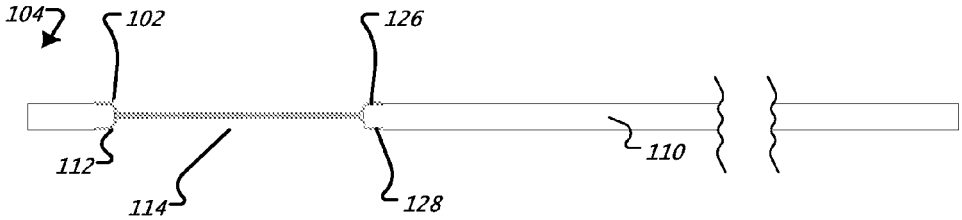

Referring now to FIG. 2B, a side view of finished sheet 104 is shown, viewed along cutline 2-1. The finished sheet 104 includes substrate 110, from which portions have been removed to form cutout 114. The thickness of the substrate 110 has been reduced in the areas near the cutouts 114. The size reduction of the reduced areas is substantially equal to the thickness of the film used, such that film layers 102, 112 fill the area of reduced thickness to produce a substantially flat surface. Film layer 102 is attached to the substrate 110 and film layer 112 by adhesive layer 126. Film layer 112 is attached to the substrate 110 and film layer 102 by adhesive layer 128.

One alternative similar to FIG. 2B, is where there is no reduction in thickness of the substrate in the areas of the cutouts. In this alternative, the thickness of the page in the area of the film layers is greater than the thickness of the page in the areas without film. Other alternatives and combinations may also be produced.

Other variations of master sheets and pages produced from substrate and film are also possible. For example, a master sheet may be prepared as generally described, and the substrate processed to remove the cutout areas. The substrate is then laminated over the entire surface of the substrate on both sides with a layer of film after removal of the substrate cutouts. FIG. 2C shows finished sheet 204. The finished sheet 204 may be trimmed from a master sheet, or may be produced directly. The finished sheet 204 is shown with a film layer 202 covering the entire surface of the substrate, including over the cutout area 214. In the area of the hinge, portions of the substrate have been removed, resulting in the cutout area 214 that has been removed. The film layer 202 has been placed such that film covers the cutout area 214, as well as the entire surface of the substrate, and extends to each edge. The film layer 202 has also been treated to provide a suitable surface for printing (e.g., a surface receptive for laser, electronic ink, inkjet, dye sublimation printing, or other printing approaches), forming a print receptive surface.

Figure 2D:
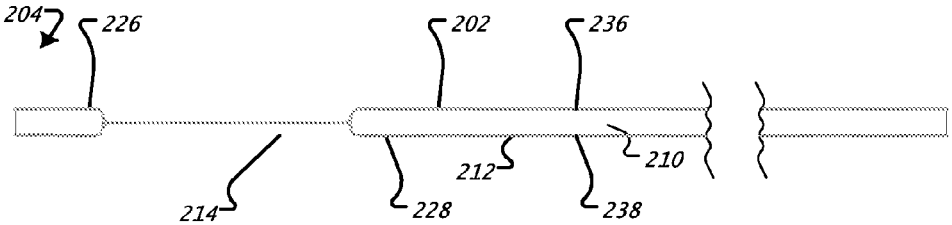

A side view of finished sheet 204 is shown in FIG. 2D, which is an exploded view of finished sheet 204, viewed along cutline 2-2. The finished sheet 204 includes substrate 210, from which portions have been removed to form cutout 214. The thickness of the substrate 210 has not been reduced on any portion of the sheet. Film layer 202 is attached to the substrate 210 and film layer 212 by adhesive layer 226. Film layer 212 is attached to the substrate 210 and film layer 202 by adhesive layer 228. Film layer 202 has been treated with print receptive topcoat layer 236. Film layer 212 has been treated with print receptive topcoat layer 238. Thus, both sides of the substrate have a prepared surface suitable for printing.

In various embodiments, the film layer may cover less than the entire surface of the substrate. For example, a thin strip of substrate may remain uncovered along the edge near the cutout area. In other embodiment, less than the entire surface of the film may be treated with a print-receptive coating. For example, a strip of substrate along the edge near the cutout area may not be treated as the area will be in the binding area and not generally visible after binding. Other variations are also possible.

The sheet size may be finalized before printing, or the pages may be printed on a master sheet and later cut to size. In one approach, the substrate used will be a plastic or film layer, and the resulting pages may be waterproof, as neither the surface nor substrate will absorb or wick water. Variously, the film or plastic layer may be white, colored, clear, or other appearance.

FIG. 3 shows examples of alternative embodiments of master sheet stocks.

Figure 3D:
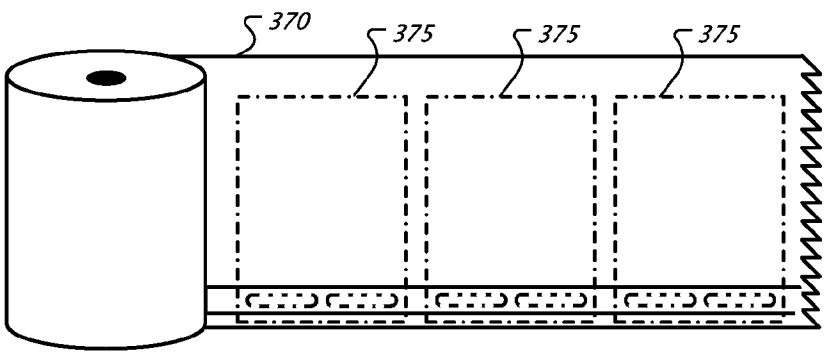
FIGS. 3A-3D show examples of alternative embodiments of master sheet stocks.
Figure 3B:
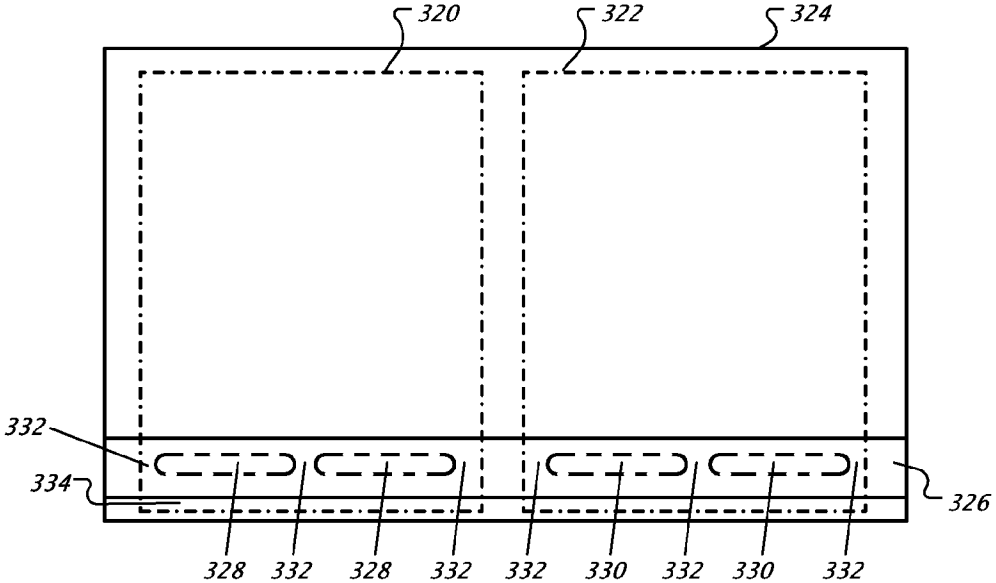
Figure 3C:
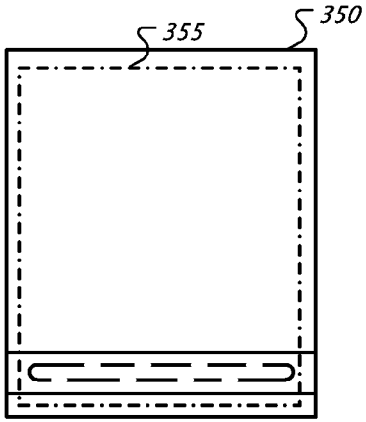
Figure 3A:
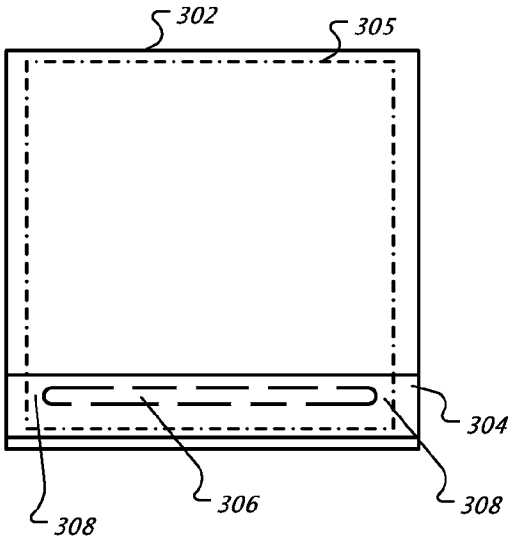

In one example, shown in FIG. 3A, a master sheet 302 has a film strip 304 along its bottom edge. Portions of the substrate have been removed, resulting in a cutout 306 that lies underneath the film strip 304. The cutout 306 does not extend all of the way to the edge of the master sheet 302. Islands of substrate forming gap stiffeners 308 remain between the cutout 306 and the edges of the master sheet 302. The film strip 304 is placed such that when the finished page 305 is trimmed from the master sheet 302, the film strip 304 runs to the edge of the finished page 305. In addition, the master sheet 302 is sized such that one finished sheet is produced from the master sheet 302 In another example, shown in FIG. 3B, multiple finished sheets (e.g., 320 and 322) can be cut from a master sheet 324. A film strip 326 is applied near the bottom edge of the master sheet 324, and the film strip 326 is placed so that a strip 334 remains between the film strip 326 and the bottom edge of the master sheet 324. Cutouts 328, 330 have been made in master sheet 324, such that two cutouts 328 have been removed along the edge of what will be finished sheet 320, and two cutouts 330 have been removed along the edge of what will be finished sheet 322. The cutouts 328 and 330 do not extend to the edges of finished sheets 320 and 322. There are multiple islands of substrate remaining around the cutouts 328 and 330 forming gap stiffeners 332. The gap stiffeners 332 provide additional stiffness to the hinged area and edge of the sheet.

FIG. 3 also illustrates that master sheets can be produced having different sizes. For example, as shown in FIG. 3A, the master sheet 302 can be a 13 inch by 13 inch sheet from which a 12 inch by 12 inch finished sheet 305 can be cut. As another example, shown in FIG. 3C, the master sheet 350 can be a 9 inch by 12 inch sheet from which an 8.5 inch by 11 inch finished sheet 355 can be cut. These examples also show that master sheet stock can come in different arrangements. Master sheets, such as sheets 302 and 350, can have one finished sheet per master sheet. As shown in FIG. 3B, other master sheets, such as sheet 324, can have multiple finished sheets 320, 322 cut from one master sheet. As shown in FIG. 3D, master sheets can also be on a roll, such as roll 370, where multiple finished sheets 375 can be cut from the roll 370.

FIG. 4 shows examples of alternative embodiments of master sheets and finished sheets.

Figure 4C:
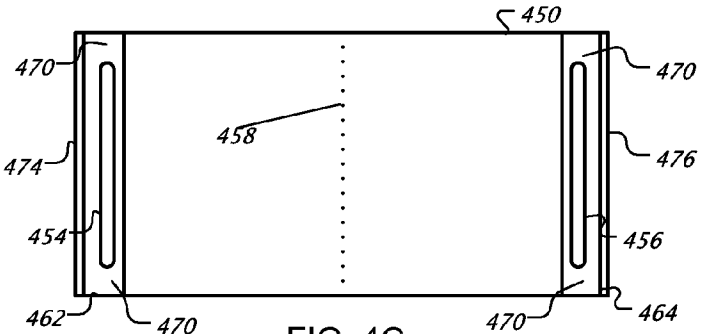
FIGS. 4A-4C show examples of embodiments of master sheets and finished sheets.
Figure 4B:
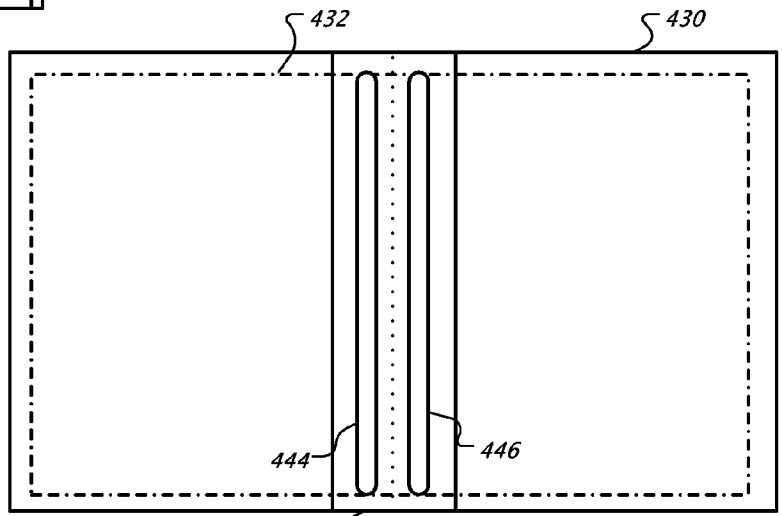
Figure 4A:
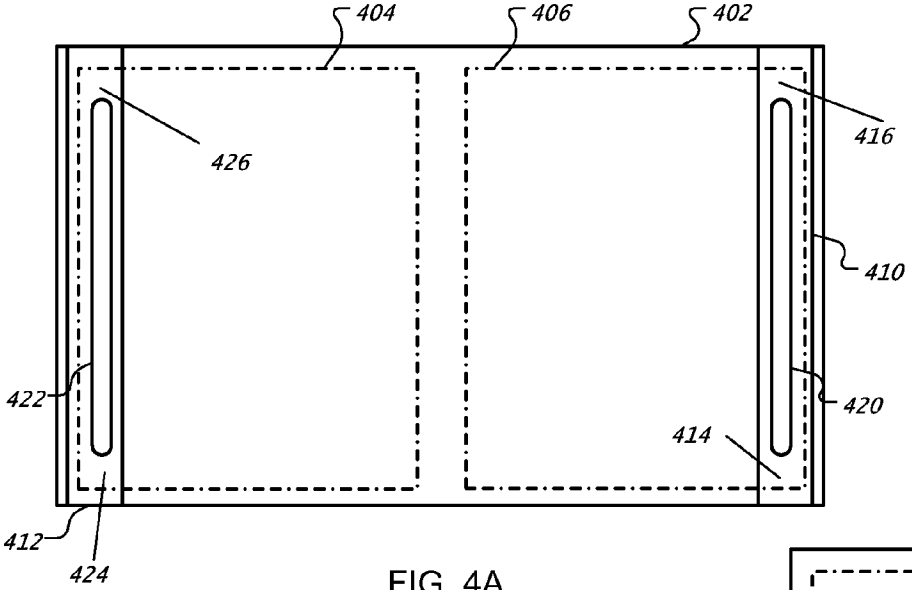

In one embodiment, shown in FIG. 4A, a master sheet 402 has a film strip 410, 412 running lengthwise near opposite side edges. Portions of the substrate have been removed, resulting in cutout 420 that lies underneath the film strip 410, and cutout 422 that lies underneath the film strip 420. The cutouts 420, 422 do not extend all of the way to the edge of the master sheet 402. Islands of substrate remain forming gap stiffeners 414, 416, 424, 426 between the cutouts 420, 422 and the edges of the master sheet 402. The film strips 410, 412 are placed such that when the finished pages 404, 406 are trimmed from the master sheet 402, the film strips 410, 412 cover the page to the edge of the finished pages 404, 406. In addition, the master sheet 402 is sized such that two finished sheets 404, 406 are produced from the master sheet 302. In one embodiment, a 12" by 18" master sheet may be used and exhibit a film strip on opposite edges of the master sheet. Then, the 12"×18" master sheet may later be cut to produce two 8½" by 11" finished sheets.

In another embodiment, shown in FIG. 4B, a master sheet 430 includes two cutout areas 444, 446 formed in parallel slots in the substrate of the master sheet 430, and running parallel down the middle of the sheet, with a portion of substrate separating the cutout areas 444, 446. The cutout areas 444, 446 may be laser cut, die cut, or removed by other methods. A strip of film 412 is then laminated on the front and back of the master sheet 430 over the cutout areas 444, 446. The film may have various attributes, as described previously. The sheet can then be printed in a variety of presses using any of the methods mentioned above. A number of pages may be assembled together in order and the sheets placed on the "saddle" of a saddle binder. Staples may then be placed in the center of the sheet through the substrate gutter that is between the cutout areas 444, 446. The sheets can then be allowed to fold in half along the laminated gaps or hinges and may then be trimmed on the three non folded sides to form the finished product pages. For example (and while in a folded configuration), a finished page 432 may be cut from the master sheet 430. Due to the presence of the flexible film areas, each page lays flat when joined together using this method.

In one illustrative approach, the overall sheet size may be 13"×18". The slots may be 12" long and the sheet will be 13" long leaving ½" of substrate on either end of each cutout slot. The pages may be printed, such as by laser printing. As one example, images could be printed that are images used to produce pages of a calendar of the type normally hung on a wall. The pages may be assembled in order of the months, and following the binding and finishing steps, the resulting calendar may then be opened up and hung on a wall. Finished pages having dimensions 12"×17" may be trimmed from the 13"×18" master sheets. When folded and bound (such as for a calendar), each individual page leaf will have dimensions of approx 8½"×12".

In another embodiment, shown in FIG. 4C, a master sheet 450 includes two cutout areas 454, 456 formed in parallel slots in the substrate of the master sheet 450, and running near each opposite outside edge of the sheet. The cutout areas 454, 456 may be laser cut, die cut, or removed by other methods. A strip of film 462, 464 is then laminated on the front and back of the master sheet over the cutout areas 454, 456. The cutouts 454, 456 do not extend all of the way to the edge of the master sheet 450. Islands of substrate remain between the cutouts and the edges of the master sheet 450 forming gap stiffeners 470. The film strips 462, 464 extend lengthwise to cover the page to the edge of the finished page 460. The filmstrips 462, 464 do not extend widthwise to the edge of the page, leaving thin strips of substrate 474, 476 between the edge of the page and film strip. Feeding and printing operations may be improved by the presence of such strips and the gap stiffeners. Neither is required however, and in other embodiments, the film strip may extend widthwise to the edge of the sheet. The master sheet 450 includes a center line 458 that may be pre-creased, slightly marked, or very slightly perforated to make folding easier. Master sheet 450 may be sized to produce sheets of the correct dimension after printing and folding.

In one illustrative approach, the master sheet may have a size of 4"×12", and be used to produced a finished sheet designed for desktop inkjet printers that are generally designed to print on only one side of the sheet. The sheet may be printed in the printer—for example, to have two 4"×6" photos printed side by side. The sheet may then be folded in half along the center line. After printing and folding, the folded finished sheet would then be 4"×6" long with a photo on each side of the folded sheet, and the flexible hinge areas aligned. This folded sheet could then be bound together with other sheets using methods previously discussed.

FIG. 5 shows alternative embodiments of finished sheets. Generally, finished sheets may be trimmed from master sheets as described previously. In some embodiments, finished sheets may be produced directly for various uses, such as printing or use by an individual user.

Figure 5A:
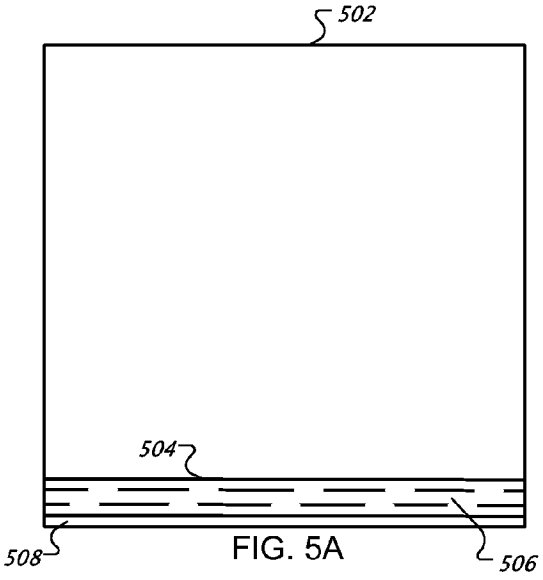
FIGS. 5A-5D show alternative embodiments of finished sheets.

In one example, shown in FIG. 5A, a finished sheet 502 has a film strip 504 along its bottom edge. A cutout 506 runs along the entire edge, underneath the film. The film strip 504 is placed so that a substrate strip 508 remains between the film strip 504 and the bottom edge of the finished sheet 502. This finished sheet is an example of a sheet that may be cut from a master sheet. The islands or gap stiffeners that were present in the master sheet to assist in providing stiffness during printing, etc., have been removed during trimming to provide maximum flexibility to the finished sheet in the hinge area formed by the film.

Figure 5B:
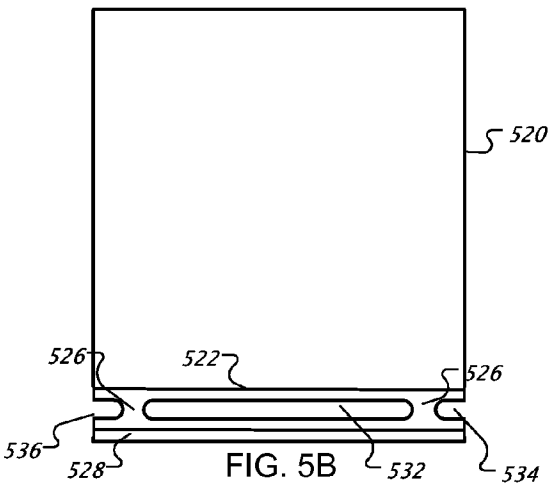

In another example, shown in FIG. 5B, a finished sheet 520 has a film strip 522 along its bottom edge. Cutout areas 532, 534, 536 lie underneath and are fully covered by the film strip 522. Cutout areas 534, 534 extend to the edge of the finished sheet 520. Cutout area 532 is entirely within the finished sheet 520. Islands of substrate are between the cutout areas 532, 534 and cutout areas 532, 536 forming gap stiffeners 526. The film strip 522 is placed so that a strip 528 remains between the film strip 522 and the bottom edge of the finished sheet 520. The strip of substrate may be useful during certain binding operations, as the strip may be more receptive to certain adhesives compared to a film layer that extended to the edge of the sheet. This exemplary finished sheet 520 includes islands in the hinge area, which provide additional stiffness compared to that of a film-only hinge area, such as in finished sheet 502 in FIG. 5A. The addition of gap stiffeners in the hinge area may be useful in providing a more "book-like" feel, and page action than a pure film hinge. Furthermore, the pages may stay in place better compared to a pure film hinge when a book incorporating such pages is left open. In other cases and implementations, a pure film hinge without islands will be preferred.

Figure 5C:
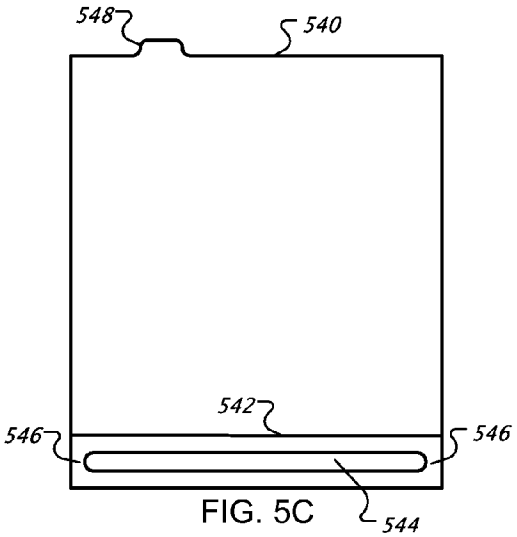

In another example, shown in FIG. 5C, a finished sheet 540 has a film strip 542 along its bottom edge. Similar to sheet 520 in FIG. 5B, sheet 540 has a cutout 544 with gap stiffeners 546 between the edges of the sheet 540 and the cutout 544. Unlike sheet 520 in FIG. 5B, the film strip 542 goes to the very bottom edge of the sheet 540. There is no substrate strip between the bottom of the film strip 542 and the bottom edge of sheet 540.

FIG. 5C also illustrates a variation that may be present in any page described herein. Rather than a straight edge on the opposite of the hinge edge, a tab 548 has been made in the edge of the sheet 540. Generally, the master sheet will be prepared as described herein, and a finished sheet having a little large width dimension will be formed from the master sheet. The finished sheet will then be run through a tabbing machine, wherein the width will be reduced (e.g., by die-cutting, laser cutting, or other method) along the edge of the sheet except for the tab, which remains. Variously, one or more tabs, having various sizes (length and width) may be produced. The tab may also have other characteristics. For example, a colored film may be placed on the edge of the substrate prior to tabbing to produce a colored tab. The tab may also be printed. Alternatively, the tabbing may be done as part of the process of trimming the finished sheet form the master sheet. In such a case, the trimming/tabbing process would be done in a single process or step, rather than two.

In one illustrative variation, sheet stocks may be produced as described above in a size of 9"×11". The sheets can then be printed in a variety of existing methods to create index tabs. The sheets are then sealed and tab cut in conventional tabbing equipment. The sheets having a flexible hinge area can be made into several types of tabs including, plain sheet tabs as used in high speed copiers, pre-printed tabs such as numbers 1 to 10 or letters A to Z, custom Printed tabs, or insertable tabs. The final tabbed page dimensions would generally be 8½"×11", with an additional ½" wide tab on part of the page.

Figure 5D:
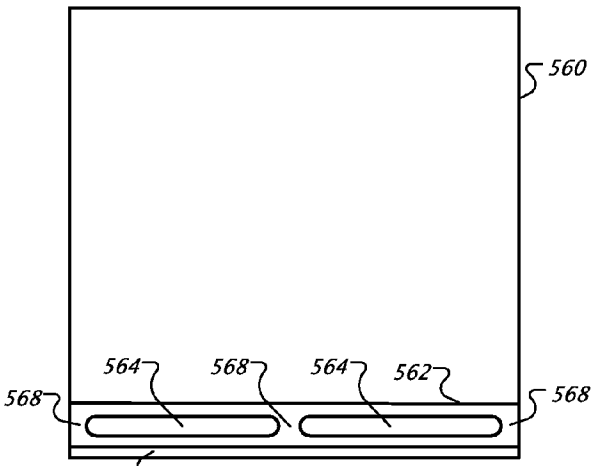

In another example, as shown in FIG. 5D, a finished sheet 560 has a film strip 562 along its bottom edge. Two cutouts 564 lie underneath the film strip 562. Islands of substrate forming gap stiffeners 568 occupy the gaps between the cutouts 564 and the edges of the finished sheet 560. The film strip 562 is placed so that a substrate strip 570 remains between the film strip 562 and the bottom edge of the finished sheet 560.

These examples also illustrate that various sizes of finished sheets may be produced. For example, finished sheets 502, 560 may have dimensions of 12" by 12", while finished sheets 520, 540 may have dimensions of 8.5" by 11".

Figure 6:
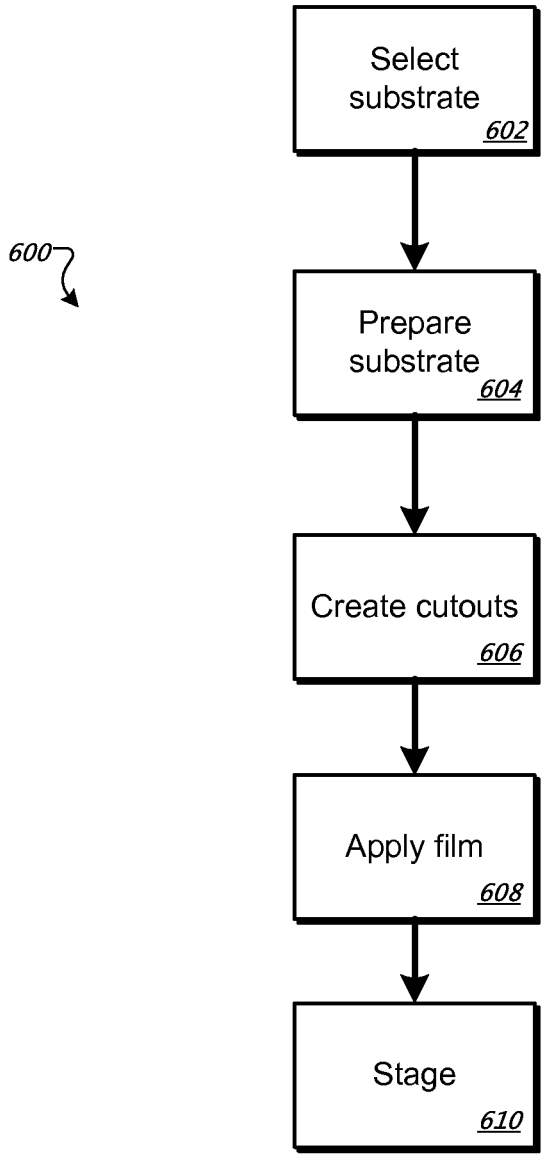
FIG. 6 shows a flowchart of one example of a master sheet manufacturing process.

FIG. 6 shows a flowchart of one example of a master sheet manufacturing process 600. The process may begin by selecting a substrate 602, and mounting a roll of substrate material (such as a paper roll, film roll, etc.), and unwinding the roll of substrate to form a substrate web (such as a paper web, film web, etc.). Variously, the dimensions of the substrate roll used, the weight of the substrate material, the color of the substrate, as well as other variables may be modified according to desire or intended application.

After the substrate is unwound to form a web, the substrate may be prepared 604. In one approach, the substrate may be calendared, or compressed, in a narrow band near one edge. The narrow band may vary in width. For example, it may have a width of ¼", ½", ¾" or other width. If calendared, the substrate can be calendared by a series of temperature-controlled rolls, such as either in a stack or a horizontal pair, which can impact heat and stress to the surface of the sheet.

In another approach, the substrate may be thinned in a narrow band near one edge. Again, the width of the band may vary, and may have a width of ¼", ½", ¾" or other width. The substrate may be thinned by sanding, for example, by using one or multiple high-speed sanding belts.

The substrate web may also be marked periodically at a set distance for later use in processing. For example, the substrate may be marked to assist in creating the cutouts, or in finishing the master sheet. In one example, marks are made every 18" along the substrate web. The marks may be a punch or hole in the substrate web, a visible or invisible ink dot, or other type of mark.

In step 606, cutouts are created. Sections of the substrate are removed by die cutting, laser cutting, punching, or some other method. In general, the cutouts do not extend to the edges of the sheets. Therefore, the substrate generally retains a continuous, undisturbed, and uncut edge or perimeter. The cutouts may be created by various methods including die-cutting, laser cutting, punching, etc. In some implementations, the perimeter will not be continuous, as cutouts will extend to the edge of the sheet.

In step 608, film is applied to the substrate. Various films, having various coatings or surface treatments, as described earlier in the description, may be applied to the substrate. Generally, the film is applied to both sides of the substrate in a narrow strip, covering the cutouts that have been removed. The film may be applied to both sides simultaneously, or sequentially. Alternatively, the film may only be applied to the upper or lower surface of the substrate. The film may be compressed into the upper and lower surfaces of the substrate.

In step 610, the master sheets are staged. Depending on the desired application, the product may be staged in various forms. In one approach, the substrate web may be taken up on a reel and rolled to produce a master sheet roll which may be used in high-speed commercial equipment. In another approach, the web may be cut to produce master sheets that may be trimmed later to produce one or more finished sheets. In another approach, the substrate web may be cut to produce finished sheets for direct use.

The pages described herein may be used for various purposes. One use is to use the pages for printing, and then to bind the pages together in a book, presentation, display folder, calendar, etc. In general, this will require a binding arrangement. The binding arrangement will include a binding element, front and back cover, and one or more pages within the covers. Generally, the binding element may be of any kind generally used for binding, such as the elements used in perfect binding, velo binding, spiral binding, post binding, side sewing, stapling, etc. The front and back covers may be of the type generally used in binding, and may be the same or different. In one approach, pages such as described herein may be used for the front and back covers. This may be especially useful for calendars, etc. The one or more pages within the front and back cover may be of the type described herein. The flexible hinge area in the one or more pages enables the one or more pages to lie flat when the binding arrangement is opened.

EXAMPLES

Example 1

1. A roll of 80 pound paper having 12" width (Appleton Coated Products of Appleton Wis.) was unwound and fed into the process in a paper web.

2. The paper web was calendared, or compressed, in a narrow band, ½" wide, near one edge of the paper.

3. Two sections of the paper, ⅛" by 8¾" long, were removed by die cutting from the area of the paper web that was calendared. The die cutting step was repeated every 18 inches along the paper web, as the paper web passed through.

4. A roll of print-receptive polyester film (available from Transilwrap, Chicago, Ill.), 0.0001" thick, was unwound and coated with an adhesive mixture. The adhesive mixture was produced by blending 98.5% vol PN3759K (Fuller Adhesives, St. Paul, Minn.) and 1.5% vol cross-linker XR-2990 (Fuller Adhesives).

5. The polyester film was adhesively applied to both sides of the paper web in a narrow strip covering the section of the paper web that was removed by the die cutting.

6. The web construction was fed into a sheeter and was cut in a predefined location causing the two die cut portion to be equally spaced within an 18" long sheet. The final dimensions of each cut master sheet were 12"×18".

Example 2

1. A roll of 100 pound paper having 14" width (Digital Silk by New Page Corporation of Trumbull Conn.) is unwound and fed into the process in a paper web.

2. The paper web is run under a high speed sanding belt. A section of the paper ½" wide by 0.001" deep is removed.

3. Steps 3 through 5 from Example 1 are carried out.

4. The web construction is rewound into a roll with a 3" core and has a final outside diameter of 40".

The paper rolls may later be sheeted to size before or after printing. Roll fed material may be printed in a similar manner to sheet stock but on slightly different equipment (such as HP Indigo w3250, Hewlett Packard Co.)

Example 3

The same steps as in Example 1 or 2 may be carried out on a variety of papers or other substrate materials.

For example, paper may be used that may have different weights, colors, and having a variety of widths of the paper web, widths of the film strip, and film strip position. Thus, the paper variables may be modified to provide a variety of sheet sizes. This may be done to accommodate the printing equipment used, and the desired size of the finished document. Different paper weights may also be used for various applications.

Other substrate materials, such as plastics, film, paper/cotton fiber blends, etc., may also be used to produce the products of Examples 1 and 2.

Example 4

A stack of 12" by 18" master sheet stock (produced according to Example 1), was loaded into the feed drawer of a digital printer (Indigo 5000, Hewlett-Packard Company of Atlanta Ga.). The sheet stock was then printed on both sides during printing operations.

The printed sheet stock was trimmed to a finished size of 11" by 8½". During the trimming process approximately ¼"

was trimmed from each 12" outside edge and ½" was trimmed from the center of the sheet. Approximately ½" was trimmed from each 18" edge. The trimmed sheets then had a film-covered flexible hinge running along the finished 8½" edge, located approximately ½" from the sheet edge.

The trimmed sheets were then bound with a pre-made hard cover (Photo Book Creator, from Unibind, Atlanta, Ga.) to produce a book. The bound pages in the book did lie flat when the book was opened.

Example 5

Another form of master sheet stock in roll form may be used in photo printers, such as found in photo kiosks. Production of photo kiosk rolls will differ slightly from that described in Example 2, but requires the same basic steps. A roll of substrate material is unwound. A slot is die cut into the material. The slot is covered on one or two sides with a clear or opaque film. The roll is re-wound.

In this embodiment the web of substrate, which is typically dye-sublimation paper, may be 4" wide and several hundred feet long. After unrolling, a cutout slot that is ⅛" long and 3¾" wide running across the 4" wide web may be cut from the substrate material. These slots repeat on the web at intervals of 6½". The web is then rewound and ready for use at the photo printer.

When producing photos, the roll of material is unwound at the printer to form a web of material that may be printed in the normal manner. After printing, the material exits the machine in increments of 6½" in length. After the photo is printed, the machine cuts off the photo leaving a ½" long×4" wide non-printed area that contains the flexible film area. After printing photos in this manner, a number of photos may be bound in several ways such as stapling, sewing, gluing etc. After binding the photos will be able to lay flat for viewing due to the flexible film area.

In other embodiments, the photo printers will use cut sheets, rather than a roll of material for printing. The approach is the same, except there is no cutting of the material in lengths after printing. Similarly to the roll embodiment, the resulting photos can be bound and will lay flat due to the flexible film area.

A number of embodiments of the invention have been described. Nevertheless, it will be understood that various modifications may be made without departing from the spirit and scope of the invention. For example, the dimensions of the substrate roll used, the dimensions of the sheet stock, the dimensions of the finished document, the weight of the substrate material, the location and size of the film strip, the color of the substrate, as well as other variables may be modified according to desire or application. Accordingly, other embodiments are within the scope of the following claims.

What is claimed is:

1. A sheet stock, comprising:

a page comprising a substrate adapted to receive a printed image;

a hinge strip comprising a substrate, the hinge strip and the page defining a gap therebetween;

a flexible film having a lower surface adhesively bonded to a portion of an upper surface of the page and to at least a portion of an upper surface of the hinge strip to span the gap and provide a flexible hinge for the sheet stock, the flexible film leaving a portion of the upper surface of the page exposed, the flexible film comprising a print receptive coating or treatment on an upper surface; and at least one gap stiffener extending from the page to the hinge strip.

2. The sheet stock of claim 1, further comprising a second flexible film applied to at least a portion of a lower surface of the page and to at least a portion of a lower surface of the hinge strip to span the gap.

3. The sheet stock of claim 1, wherein the flexible film is compressed into the surface of the page.

4. The sheet stock of claim 1, wherein the flexible film has a matte finish.

5. The sheet stock of claim 1, wherein the flexible film is opaque.

6. The sheet stock of claim 1, wherein the thickness of the substrate has been reduced in the area where the flexible film is applied to the substrate.

7. The sheet stock of claim 1, wherein the thickness of the sheet stock where the flexible film is applied has a thickness that differs by 0.002" or less compared to the thickness of the sheet stock where the substrate is not covered by flexible film.

8. The sheet stock of claim 1, wherein there is a strip of substrate between the edge of the sheet stock and the edge of the flexible film.

9. The sheet stock of claim 1, wherein the flexible hinge area is from about 0.03 inches to about 0.25 inches in width.

10. The sheet stock of claim 1, wherein the at least one gap stiffener comprises a piece of substrate.

11. The sheet stock of claim 10, wherein the page, the hinge strip, and the at least one gap stiffener are formed from a single piece of substrate, the gap between the page and the hinge strip being formed by cutting an opening in the single piece of substrate.

12. The sheet stock of claim 1, further comprising at least a second gap stiffener extending from the page to the hinge strip.

13. The sheet stock of claim 1, wherein the flexible film is translucent or semi-transparent.

14. The sheet stock of claim 1, wherein the lower surface of the flexible film is adhesively bound to the at least a portion of the upper surface of the page and to the at least a portion of the upper surface of the hinge strip with an adhesive comprising a crosslinking additive.

15. A sheet stock comprising:

a substrate comprising a page area and a hinge strip area, the substrate defining at least one opening between the page area and the hinge strip area, the substrate further comprising at least one gap stiffener extending between the page area and the hinge strip area in the region of the opening;

a flexible film covering the opening, adhesively bonded to at least a portion of the substrate, and defining a flexible hinge area in the region of the opening and gap stiffener covered by the film, wherein the flexible film comprises a print receptive coating or treatment.

16. The sheet stock of claim 15, wherein the flexible film has a matte finish.

17. A sheet stock, comprising:

a page comprising a substrate adapted to receive a printed image;

a hinge strip comprising a substrate, the hinge strip and the page defining a gap therebetween;

at least one gap stiffener extending from the page to the hinge strip; and a flexible film having a lower surface bonded to a portion of an upper surface of the page and to at least a portion of an upper surface of the hinge strip to span the gap and provide a flexible hinge for the sheet stock, the flexible film leaving a portion of the page exposed, the portion of the page where the flexible film is applied having a smaller thickness as compared to a thickness of the page where the substrate is not covered by flexible film, the flexible film being opaque or translucent, the flexible film comprising a print receptive coating or treatment on an upper surface.

18. The sheet stock of claim 17, wherein the lower surface of the flexible film is adhesively bound to the portion of the upper surface of the page and to the portion of the upper surface of the hinge strip with an adhesive comprising a crosslinking additive.

* * * * *

UNITED STATES PATENT AND TRADEMARK OFFICE

CERTIFICATE OF CORRECTION

PATENT NO. : 8,668,228 B2
APPLICATION NO. : 12/042867
DATED : March 11, 2014
INVENTOR(S) : Thomas A. Holmberg It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1306 days.

Signed and Sealed this
Twenty-first Day of July, 2015

Michelle K. Lee

Michelle K. Lee
*Director of the United States Patent and Trademark Office*